United States Patent [19]

Porter

[11] Patent Number: 4,609,794

[45] Date of Patent: Sep. 2, 1986

[54] PRINTED CIRCUIT SWITCH FOR WINDSHIELD WIPER MOTOR

[75] Inventor: David L. Porter, Westland, Mich.

[73] Assignee: Ford Motor Company, Dearborn, Mich.

[21] Appl. No.: 771,100

[22] Filed: Aug. 30, 1985

[51] Int. Cl.[4] ..... H01H 3/42; H01H 19/20

[52] U.S. Cl. ..... 200/24; 200/11 G; 200/27 A; 200/153 L

[58] Field of Search ..... 200/11 R, 11 A, 11 DA, 200/11 G, 11 J, 11 K, 11 TW, 17 R, 18, 23, 24, 25, 28, 37 A, 37 N, 292, 27 A, 153 L

[56] References Cited

U.S. PATENT DOCUMENTS

| | | | |
|---|---|---|---|
| 3,011,114 | 11/1961 | Steeb | 318/674 |
| 3,035,128 | 5/1962 | Maynard | 200/24 |
| 3,736,390 | 5/1973 | Lockard | 200/11 G X |
| 4,038,504 | 7/1977 | McAnulty et al. | 200/11 DA |
| 4,232,207 | 11/1980 | Kuhl et al. | 200/11 R |
| 4,246,453 | 1/1981 | Marchese et al. | 200/11 R |
| 4,379,955 | 4/1983 | Comerford | 200/11 DA |
| 4,392,030 | 7/1983 | Buss | 200/11 R |

FOREIGN PATENT DOCUMENTS 1305422 1/1963 France .

*Primary Examiner*—J. R. Scott

*Attorney, Agent, or Firm*—Peter Abolins; Robert D. Sanborn

[57] ABSTRACT

A switch includes three blade contact terminals against which is biased a rotating printed circuit board. The printed circuit board is rotationally moveable with respect to the blade contacts and has conductive elements on a first side of the printed circuit board for selectively contacting the switching contacts in response to the relative rotation between the switching contacts and the printed circuit board. The conductor elements include a tab for extending around the edge of the printed circuit board to a second side of the printed circuit board so as to provide electrically connected regions on both first and second sides of the printed circuit board. An electrically conducting resilient contact abuts the second side of the printed circuit board and biases the printed circuit board against the switching contacts. The tab and resilient contact can be coupled to a ground potential.

10 Claims, 17 Drawing Figures

FIG. 3
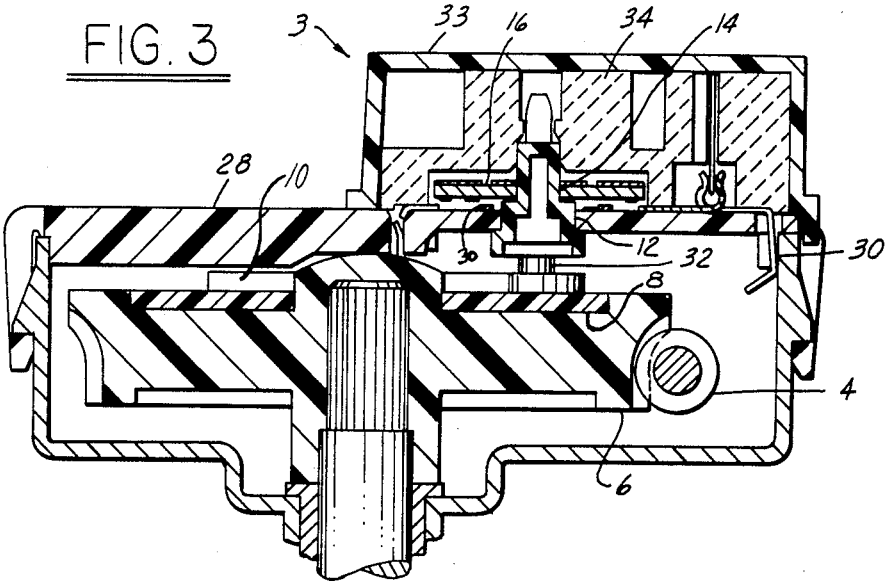
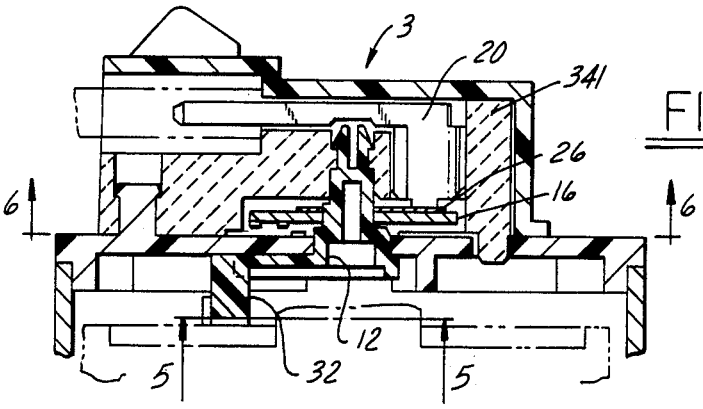
FIG. 4
FIG. 5
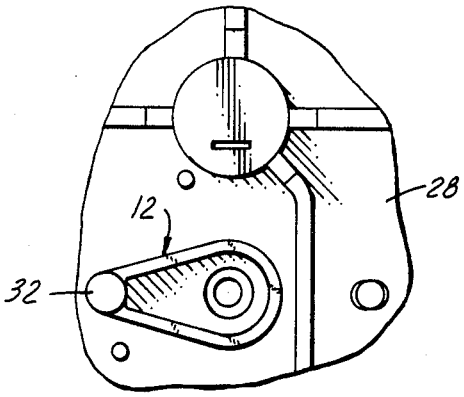
FIG. 6
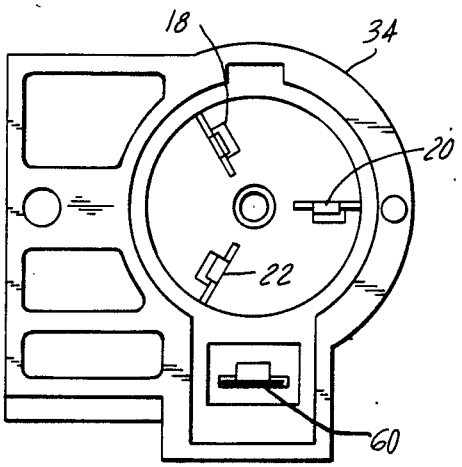

POSITION OF CAM FOLLER 32
FORWARD RUN
REVERSE RUN
PARK

PRINTED CIRCUIT SWITCH FOR WINDSHIELD WIPER MOTOR

BACKGROUND OF THE INVENTION

1. Field of the Invention

This invention relates to contact devices wherein a printed circuit cooperates with contact brushes to make and break circuits in accordance with the relative movements of the elements.

2. Prior Art

The use of a printed circuit board and a rotary switch is generally disclosed in U.S. Pat. Nos. 4,038,504 issued to McAnulty et al, 4,232,207 issued to Kuhl et al, 4,246,453 issued to Marchase et al, 4,379,955 issued to Comerford and 4,392,030 issued to Buss. However, none of these patents teach a rotary switch which is driven by a motor.

French Pat. No. 1,305,422 is directed to a windshield wiper control system and teaches a control 26 which may be moved into one of three positions to connect one of three contacts 5, 6, 7 to a rotating metal disc 1 having three annular contact portions 2, 3, 4. U.S. Pat. Nos. 3,011,114 issued to Steeb and 3,035,128 issued to Maynard, generally teach a motor driven printed circuit board switch. The patent to Maynard teaches a switch using stationary contacts against which rotating printed circuit boards are spring-loaded.

There still remains a need for a simpler, less costly rotary switch with improved reliability and ease of assembly. These are some of the problems this invention overcomes.

SUMMARY OF THE INVENTION

This invention recognizes that a rotating circuit board can be positioned against three contacts, which define a plane, and that a fourth contact can be provided on the opposite side of the printed circuit board by a conductive tab bent over from the first side of the circuit board positioned against the three contacts to the other side of the circuit board. That is, a circuit board ground conductor, at the periphery of the circuit board, communicates to the circuit board's reverse side via at least one conductive tab which is bent over the edge of the circuit board and eliminates the need for a double-sided board or rivets through the board to provide a fourth contact. A flat conductive bias spring can serve as a grounding circuit path for the fourth contact as well as loading the printed circuit board against the three fixed contacts. The flat spring can also provide sufficient friction to prevent the switch from rotating except under a positive force from an actuating cam. As a result, there is no requirement for switch detents to secure the switch.

The switch is actuated by a crank driven by a cam configuration on the gear train of the motor being controlled. The combination of the cam and a cam follower of the crank actuator sense the direction of motor rotation and actuate the switch assembly accordingly. The cam and cam follower are designed so that no combination of motor rotation and switch position can result in a mechanical lockup which could damage the cam follower or switch. This avoids the problem of damaging the cam or cam follower if the motor is inadvertently hooked up with reverse polarity.

BRIEF DESCRIPTION OF THE DRAWINGS

FIG. 3 is a section view along section line 3—3 of FIG. 2 including a side view of a printed circuit board driven by a crank actuator following a cam in accordance with an embodiment of this invention;

FIG. 4 is a section along section line 4—4 of FIG. 2 including a side section of a printed circuit board, a contact to the printed circuit board, a crank driving the circuit board and a cam for driving a crank, in accordance with an embodiment of this invention;

FIG. 5 is a bottom plan view of a crank actuator along the direction of arrows 5—5 of FIG. 4;

FIG. 6 is a bottom plan view of three electrical blade contacts for electrically contacting the circuit board along the direction of arrows 6—6 of FIG. 4 in accordance with an embodiment of this invention;

DETAILED DESCRIPTION OF THE INVENTION

Figure 1:
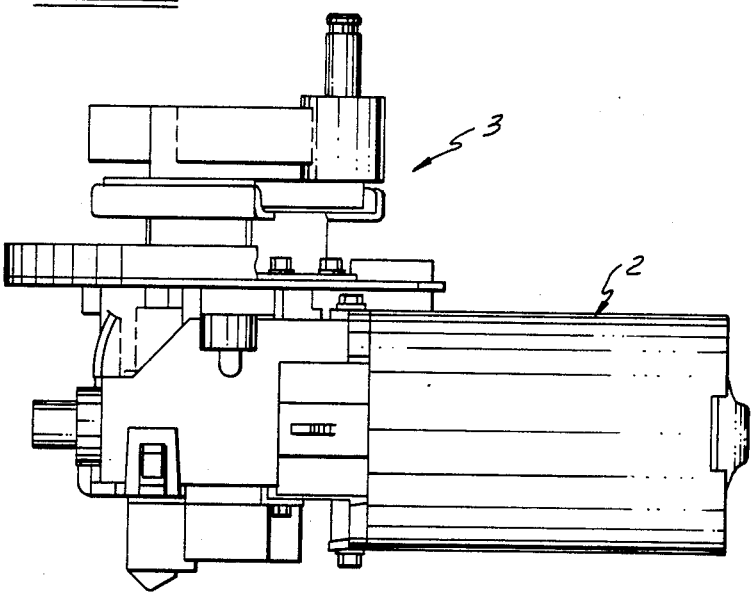
FIG. 1 is a side view of a windshield wiper motor and motor output arm assembly in accordance with an embodiment of this invention.
Figure 2:
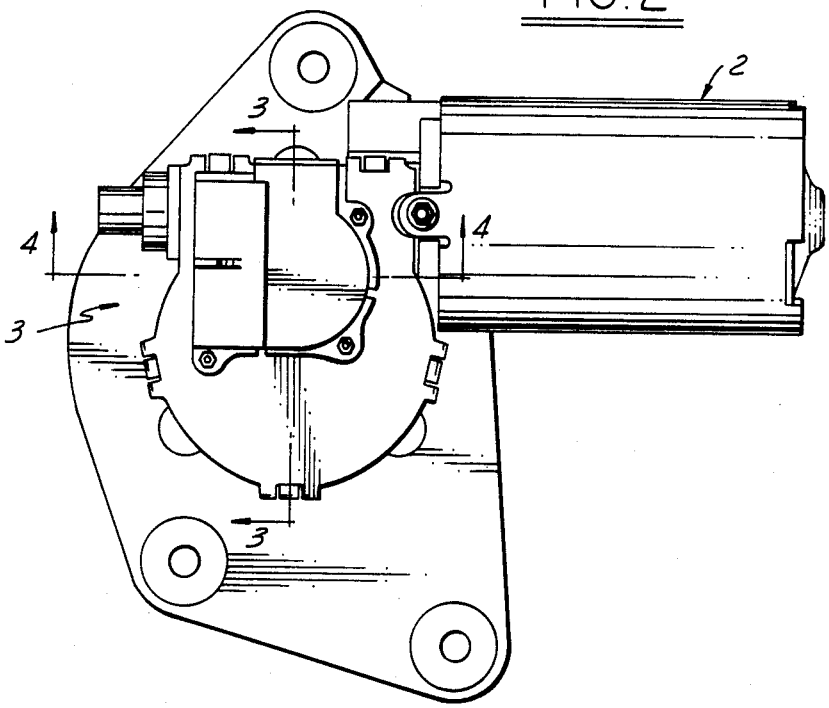
FIG. 2 is a plan view of the motor and motor output arm assembly of FIG. 1.
Figure 7:
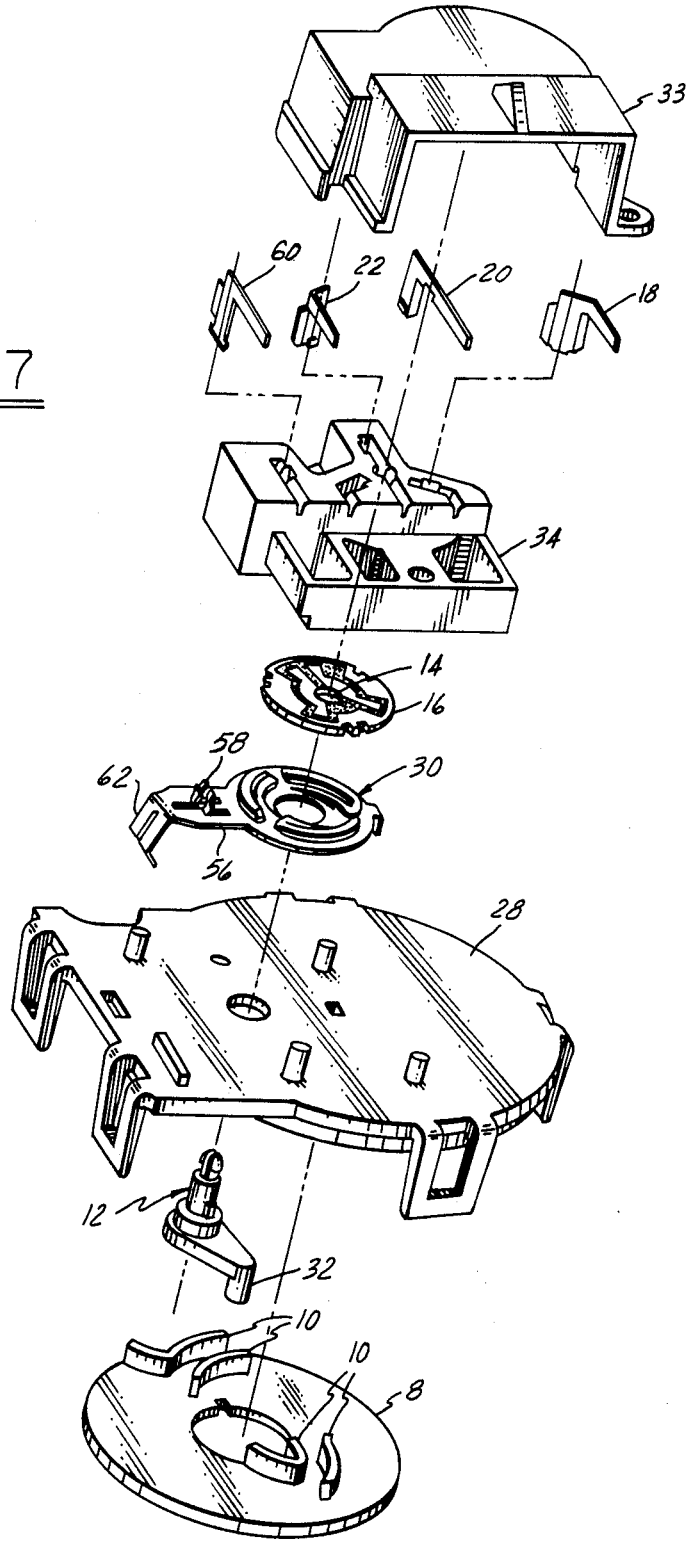
FIG. 7 is an exploded perspective view of a cam, cam follower and crank, spring, rotary printed circuit, electrical contact blade, blade holder and cover, in accordance with an embodiment of this invention.
Figure 8:
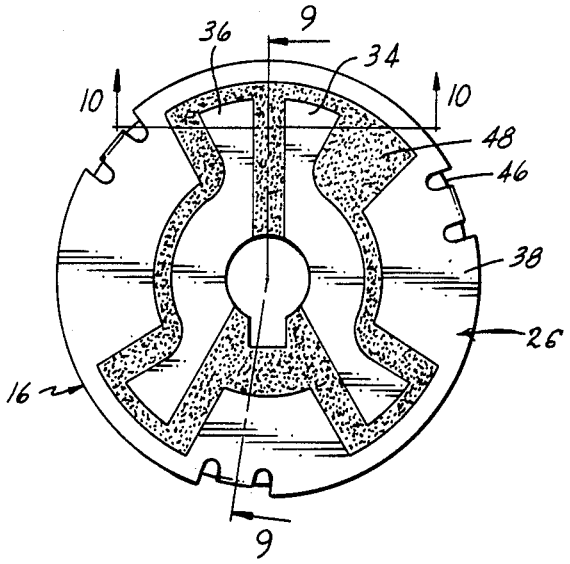
FIG. 8 is plan view of a rotary printed circuit board in accordance with an embodiment of this invention.
Figure 9:
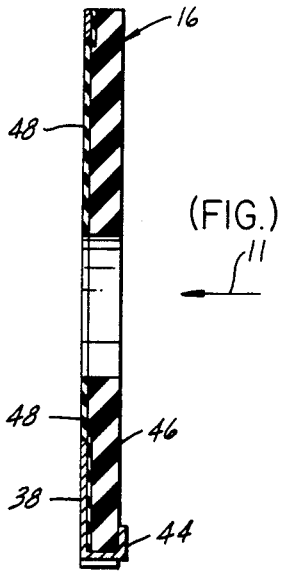
FIG. 9 is a section view along section line 9—9 of FIG. 8 including a bent tab from one surface of the printed circuit board to another surface of the printed circuit board.
Figure 10:
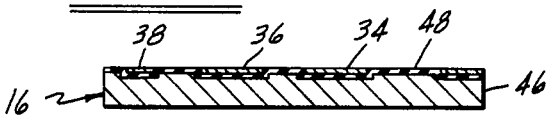
FIG. 10 is a cross section view along section line 10—10 of FIG. 8.
Figure 11:
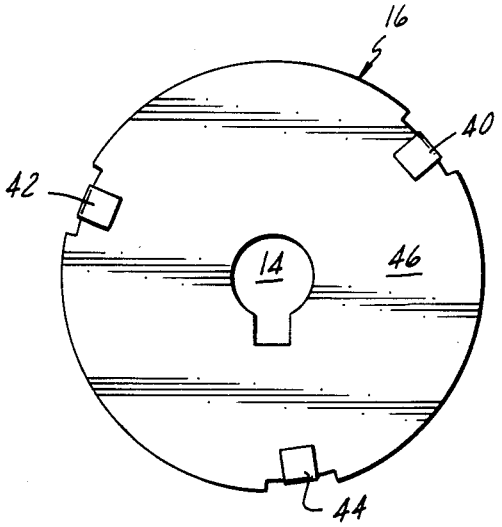
FIG. 11 is a bottom plan view of the reverse side of the printed circuit board of FIG. 8 in a direction as indicated by the arrow labeled FIG. 11 in FIG. 9.

Referring to FIGS. 1 and 2, a windshield wiper motor 2 drives an output arm assembly 3 which is coupled to an automobile windshield wiper. Referring to FIGS. 7 and 3, motor 2 drives a worm gear 4 which in turn drives the periphery of a toothed gear wheel 6. A cam plate 8 with cam guides 10 is placed on one face of toothed gear wheel 6 for driving a cam follower 32 of a crank actuator 12. Cam follower 32 is an extension radially displaced from the main axis of rotation of crank actuator 12. Crank actuator 12 has a key which is coupled through a key hole 14 in a printed circuit 16 and rotationally drives printed circuit 16.

Toothed gear wheel 6 is supported within a housing 28 which has an opening for passing crank actuator 12. A biasing spring 30 rests on housing 28 and acts to force printed circuit 16 against electrical blade contact terminals 18, 20 and 22. A housing 33 is attached to housing 28 over a plastic blade holder 341 which supports electrical blade contact terminals 18, 20 and 22. In FIG. 4, it can be seen in cross section that blade 20 extends down toward printed circuit 16 and contacts a conductive path 26 on printed circuit 16.

The three electrical blade contact terminals 18, 20, 22 are equally spaced around an axis about which printed circuit 16 pivots (FIG. 6). Contact terminals 18, 20, 22 are each formed of a conductive material such as a copper alloy and are formed into a flat terminal blade with a rounded contact surface adjacent printed circuit 76. The three contact surfaces of terminals 18, 20, 22 define a plane so that the printed circuit 76 can be held against the three contact surfaces at all times by biasing spring 30. That is, printed circuit 16 could not necessarily rest with stability on more or less than three fixed contact surfaces simultaneously.

Referring to FIGS. 8, 9, 10 and 11, conductive path arrangement 26 on a side of printed circuit 16 includes a central angled conductive path 34, a central angled conductive path 36 and a peripheral ground conductive path 38 extending around the circular perimeter of printed circuit 16 and having tabs 40, 42, and 44 bent around the edge of printed circuit 16 to the other side of printed circuit 16. Keyhole 14 is in the central portion of printed circuit 16 and passes crank actuator 12 so that rotation of crank actuator 12 causes corresponding rotation of printed circuit 16. Conductive paths 34, 36 and 38 are supported on an insulating disc 46 which provides the structural support for printed circuit 16. An insulating film 48 is on insulating disc 46 extending between and under conductive paths 34, 36 and 38.

Figure 13:
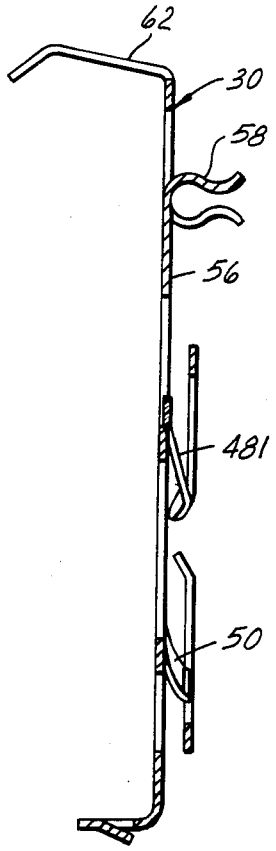
FIG. 13 is a cross section view along section line 13—13 of FIG. 12.
Figure 12:
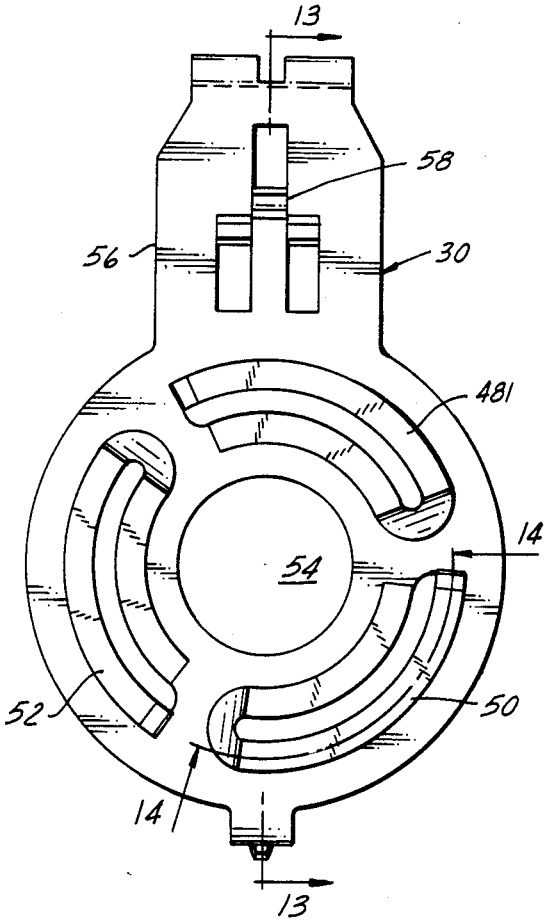
FIG. 12 is a plan view of a spring for biasing a printed circuit board.
Figure 14:
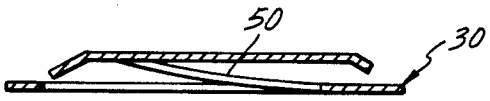
FIG. 14 a cross section view along section line 14—14 of FIG. 12.

Referring to FIGS. 12, 13 and 14, biasing spring 30 includes three arcuate springs 481, 50 and 52 each taking up somewhat less than about one-third of the circumference of a central portion of biasing spring 30. A central opening 54 in biasing spring 30 passes crank actuator 12. A handle portion 56 extends off the circular central portion of biasing spring 30 and includes a clip 58 for coupling to a blade 60 held by plastic blade holder 341. Blade 60 is connected to ground by an external connection (not shown). An angled clamping portion 62 extends at about a right angle from handle portion 56 around the top of housing 28 to secure biasing spring 30.

Figure 15:
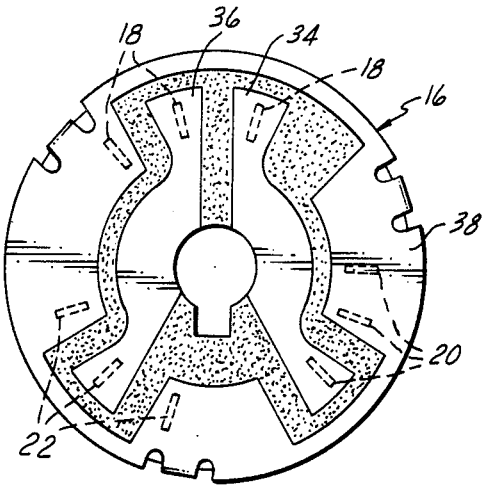
FIG. 15 is a plan view of a printed circuit board in accordance with an embodiment of this invention including superimposed dotted outline of the positions of the blade contact positioned against the printed circuit board.
Figure 16:
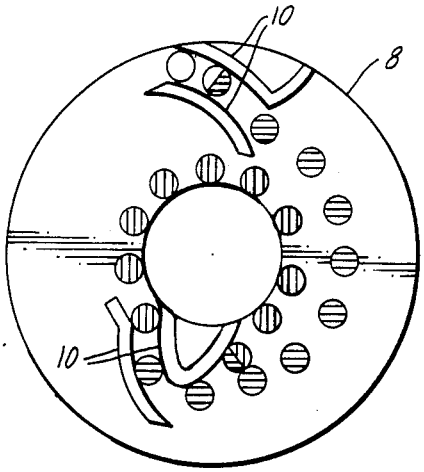
FIG. 16 is a plan view of the cam for actuating the cam follower and crank driving the printed circuit board with the various positions of the cam follower indicated on the cam and coded for forward run of the windshield wiper motor, reverse run of the windshield wiper motor, and park position of the windshield wiper motor.
Figure 17:
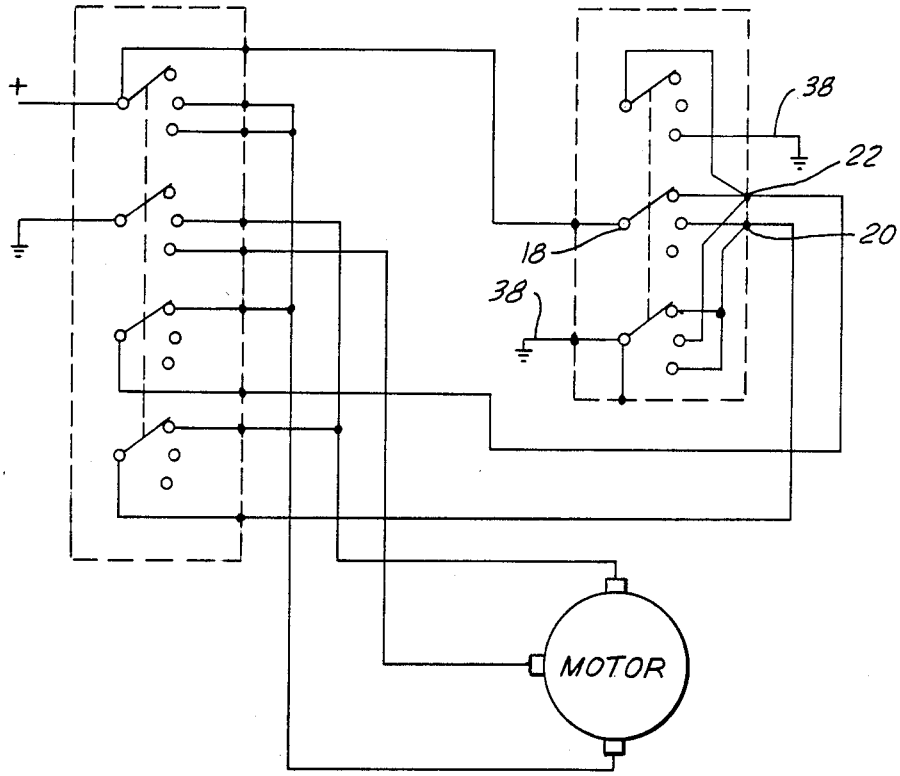
FIG. 17 is an electrical circuit diagram of the electrical switching and coupling action of the rotation of a printed circuit board against contacts in accordance with an embodiment of this invention.

In operation, toothed gear wheel 6 rotates and actuates cam follower 32 of crank actuator 12 which oscillates through about a 30° angle and drives printed circuit 16 in rotation. FIG. 16 shows the position of cam follower 32 as it follows cam guides 10 of cam 8 when cam 8 rotates. FIG. 15 shows the relationship between the contact surfaces of terminals 18, 20 and 22 and conductive paths 34, 36 and 38 as printed circuit 16 rotates. The corresponding electrical circuit formed by such contacts is shown in FIG. 17. Copper foil regions of conductive path arrangement 26 alternately make and break contacts with three electrical contact surfaces of blade terminals 18, 20, 22 abutted against printed circuit 16. The outer ring 38 of the printed circuit board 16 is connected to ground by biasing spring 30 which contacts three copper tabs 40, 42, 44 bent from the first surface of printed circuit 16. This arrangement connects blade terminals 18, 22 to ground as determined by appropriate rotation of printed circuit 16. The advantages include improved simplicity by having fewer parts, reduced cost, less space and less weight.

The cam driven oscillating printed circuit 16 accomplishes switching action. Depending on the angular position of the output gear 6 and its direction of rotation, cam follower 32 is pushed into one of three positions, each position orienting the circuit board 16 under the three contact surfaces of terminals 18, 20, 22 so as to electrically connect the switch terminals as shown in FIGS. 15 and 17 and the following table:

| | Switch Logic: |
|---|---|
| Switch Position | Switch Makes Contact Between Terminals |
| 1. Forward Run | 20 to 22; and 20 to ground |
| 2. Reverse Run | 18 to 20; and 22 to ground |
| 3. Park | 18 to ground; and 22 to ground |

As the printed circuit board 16 oscillates beneath the three contacts 18, 20, 22, the contacts 18, 20, 22 touch the conductors 34, 36, 38 in various positions. In some positions, the contacts 18, 20, 22 touch the outside conductor ring 38 on the printed circuit board 16 and are electrically grounded through the three tabs 40, 42, 44 of the ground ring 38 which are bent over the side of the printed circuit board 16 and contact the biasing spring 30 which contacts a grounding connection 60. Thus, the biasing spring 30 simultaneously forces the printed circuit board 16 against the three contacts 18, 20, 22 and provides the electrical ground needed by the outer conductor path 38 of the printed circuit board 16.

The left portion of FIG. 17 includes a schematic representation of the driver control switch for windshield wiper actuation. The control switch is a mechanical, three position ganged switch and may, for example, be located on the instrument panel of a vehicle. The ganged switch can be set so the windshield wiper system is in a park position, operating at high speed or operating at low speed. The right portion of FIG. 17 includes a schematic diagram of a wiper motor park switch. The schematic diagram illustrates how ground blade 60 and terminals 18, 20 and 22 are connected to actuate the motor to conditions of forward run (F), reverse run (R) and park (P).

Various modification and variations will no doubt occur to those skilled in the various arts to which this invention pertains. For example, a particular configuration of the biasing spring and the driving cam may be varied from that described herein. These and all other variations which basically rely on the teachings through which this disclosure has advanced the art are properly considered within the scope of this invention.

I claim:

1. A switch comprising:

at least two spaced switching contacts;

a printed circuit board means rotationally moveable with respect to said switching contacts and conduction elements disposed on a first side of said printed circuit board for selectively contacting said switching contacts in response to relative rotation between said switching contacts and said printed circuit board means;

at least one of said conduction elements further including a tab means for extending around the edge of said printed circuit board means to a second side of said printed circuit boards means, opposite from said first side, so as to provide electrically connected regions on both said first and second sides of said printed circuit board means;

a shaft means coupled to said printed circuit board means for turning said printed circuit board means;

a resilient contact means coupled to said second side of said printed circuit board means for biasing said printed circuit board means against said switching contacts; and said resilient contact means being electrically conductive and contacting said tab means.

2. A switch as recited in claim 1 wherein said printed circuit board means has an aperture for passing said shaft means and said shaft means extends through said aperture.

3. A switch as recited in claim 2 further comprising a cam coupled to said shaft and having a cam path for controlling the direction of rotation of said shaft means.

4. A switch as recited in claim 3 wherein said shaft includes a cam follower extension, radially displaced from the main axis of said shaft for engaging said cam path and controlling relative motion between said cam and said shaft.

5. A switch as recited in claim 4 wherein said at least two spaced switching contacts includes first, second and third switching contacts equally spaced about a circumference.

6. A switch as recited in claim 5 wherein said conduction elements of said printed circuit board means include a metallization on said first side of said printed circuit board means so as to selectively electrically contact said first, second and third contacts.

7. A switch as recited in claim 6 wherein said tab means and said resilient contact means are at ground potential.

8. A switch as recited in claim 7 wherein said conduction elements include a first angled conductive path on said first side of said printed circuit board means, a second angled conductive path on said first side of said printed circuit board means, and a third circumferential conductive path on said first side of said printed circuit board means extending around said first and second angled conductive paths and electrically coupled to said tab means.

9. A switch as recited in claim 8 wherein said shaft includes a key means and said aperture includes a keyhole means so that said key means can fit within said keyhole means for rotationally coupling said shaft to said printed circuit board means.

10. A switch for a windshield wiper motor comprising:

a first, a second and a third blade terminal switching contact equally spaced about a circumference and each contact having an end portion thereby defining three points of a plane;

a generally planar, circular printed circuit board aligned with said plane and rotationally moveable with respect to said switching contacts and including first, second and third conduction elements disposed on a first side of said printed circuit board for selectively contacting said switching contacts in response to relative rotation between said switching contacts and said printed circuit board means;

said first conduction element having an angled configuration which can be rotationally positioned to contact two of said first, second and third switching contacts;

said second conduction element having an angled configuration which can be rotationally positioned to contact two of said first, second and third switching contacts;

said third conduction element extending around the periphery of said first side of said printed circuit board and including portions which can be rotationally positioned to contact each of said first, second and third switching contacts and including plural tab means for extending around the edge of said printed circuit board means to a second side of said printed circuit board means, opposite from said first side, so as to provide electrically connected regions on both said first and second sides of said printed circuit board means;

an electrically conductive resilient biasing spring coupled to said second side of said printed circuit board means for biasing said printed circuit board means against said switching contacts, to prevent undesired rotational movement and to provide electrical contact between said biasing spring and said tab means;

a shaft means coupled to said printed circuit board means for causing rotation of said printed circuit board means;

said biasing spring having a central aperture for passing said shaft means therethrough;

said shaft means and said printed circuit board having coupling means for coupling rotation of said shaft means to said printed circuit board;

said shaft means having a main member generally coaxial with said printed circuit board and a radially offset cam follower; and a cam coupled to the windshield wiper motor and engaging said cam follower so that movement and position of said cam follower is responsive to the movement of the windshield wiper motor and causes said printed circuit board to be rotated into one of three positions associated with forward operation of the windshield wiper motor, reverse operation of the windshield wiper motor, and parking of the windshield wiper motor.

* * * * *